US006415123B1

(12) United States Patent
Arcaro et al.

(10) Patent No.: US 6,415,123 B1
(45) Date of Patent: Jul. 2, 2002

(54) CAROUSEL TYPE SHUTTLE COLOR PRINTER WITH ALL IN ONE EP CARTRIDGES

(75) Inventors: David J. Arcaro, Boise; Wayne E. Foote, Eagle, both of ID (US)

(73) Assignee: Hewlett-Packard Company, Palo Alto, CA (US)

( * ) Notice: Subject to any disclaimer, the term of this patent is extended or adjusted under 35 U.S.C. 154(b) by 0 days.

(21) Appl. No.: 09/689,202

(22) Filed: Oct. 11, 2000

(51) Int. Cl.[7] ..... G03G 15/01
(52) U.S. Cl. ..... 399/223; 399/227
(58) Field of Search ..... 399/223, 231, 399/226–228, 298, 299

(56) References Cited

U.S. PATENT DOCUMENTS 5,212,532 A * 5/1993 Storlie ..... 399/223 X
5,809,380 A 9/1998 Katakabe et al. ..... 399/227
5,978,642 A 11/1999 Arcaro et al. ..... 399/381
6,184,909 B1 * 2/2001 Matsuno et al. ..... 399/227 X
6,201,939 B1 * 3/2001 Yamamoto et al. ..... 399/227 X

FOREIGN PATENT DOCUMENTS

EP 0878842 A1 11/1998

* cited by examiner

*Primary Examiner*—William J. Royer
(74) *Attorney, Agent, or Firm*—James R. McDaniel

(57) ABSTRACT

This invention relates to color printing, and more particularly, to color laser printing systems. Such structures of this type, generally, employ a rotatable, carousel type shuttle color printer with all in one electrophotographic (EP) cartridges which rotate to a non-printing position such that a predetermined gap or distance between the cartridges and the transfer belt is formed in order that the various colors required to be printed upon the sheet can be printed without adversely affecting the print quality.

6 Claims, 2 Drawing Sheets

CAROUSEL TYPE SHUTTLE COLOR PRINTER WITH ALL IN ONE EP CARTRIDGES

FIELD OF THE INVENTION

This invention relates to color printing, and more particularly, to color laser printing systems. Such structures of this type, generally, employ a rotatable, carousel type shuttle color printer with all in one electrophotographic (EP) cartridges.

DESCRIPTION OF RELATED ART

It is known, shuttle type color printers to employ a paper drive. Exemplary of such prior art is commonly assigned U.S. Pat. No. 5,978,642 ('642) to D. J. Arcaro-et.al., entitled "Color Printer with Shuttle Type Paper Drive and Method." While the '642 reference utilizes a shuttle type paper drive, the disengaging of the transfer roller from the photoconductor drum during paper reversal does not yield much more than 1 mm clearance between the paper and the photoconductor drum. This 1 mm clearance may result in an inadvertent pickup of toner by the paper, which will adversely affect the quality of the printing on the paper. Therefore, while this 1 mm clearance is sufficient in many instances, it is desirable to increase clearance to 5 mm for a truly robust solution.

It is also known, in color image forming apparatus, to employ rotatable image forming units. Exemplary of such prior art is U.S. Pat. No. 5,809,380 ('380) to N. Katakabe et. al., entitled "Color Image Forming Apparatus with Plural Color Units." While the '380 reference utilizes rotatable image forming units, these units create an intermediate image before it is transferred to paper. Consequently, a more advantageous color printer would be presented if the use of the intermediate image could be eliminated.

It is apparent from the above that there exists a need in the art for a carousel type shuttle color printer with all in one EP cartridges, which at least equals the printing characteristics of the known color printers, but which at the same time provides an increased gap between the photoconductor drum and the transfer roller while the paper is being shuttled. It is a purpose of this invention to fulfill this and other needs in the art in a manner more apparent to the skilled artisan once given the following disclosure.

SUMMARY OF THE INVENTION

Generally speaking, this invention fulfills these needs by providing a carousel type shuttle color printer, comprising a rotatable color image forming unit having a plurality of different color development stations, wherein the color image forming unit is located substantially on one side of a paper to be printed upon such that the image forming unit substantially contacts the paper, and a paper transfer means located substantially adjacent to the other side of the paper such that the paper transfer means substantially contacts the paper, wherein the image forming unit rotates to an intermediate, non-printing position during a switching between the plurality of different color development stations to produce a gap between the color image forming unit and the paper transfer means.

In certain preferred embodiments, the gap is approximately 5 mm. Also, the carousel type shuttle color printer can print in a simplex or duplex mode. Finally, the paper transfer means consists of a paper shuttle path, pinch rollers, a transfer roller, and a transfer belt.

In another further preferred embodiment, the rotation of the color image forming unit creates the gap between the photoconductor drum and the transfer roller such that the paper can be easily shuttled past the color image forming unit without adversely affecting the quality of printing on the paper.

The preferred color printer, according to this invention, offers the following advantages: excellent printing characteristics; ease of assembly and repair; good stability; excellent durability; and good economy. In fact, in many of the preferred embodiments, these factors of printing characteristics, durability, and economy are optimized to an extent that is considerably higher than heretofore achieved in prior, known color printers.

The above and other features of the present invention, which become more apparent as the description proceeds, are best understood by considering the following detailed description in conjunction with the accompanying drawings, wherein like characters represent like parts throughout the views:

DETAILED DESCRIPTION OF THE INVENTION

Figure 1:
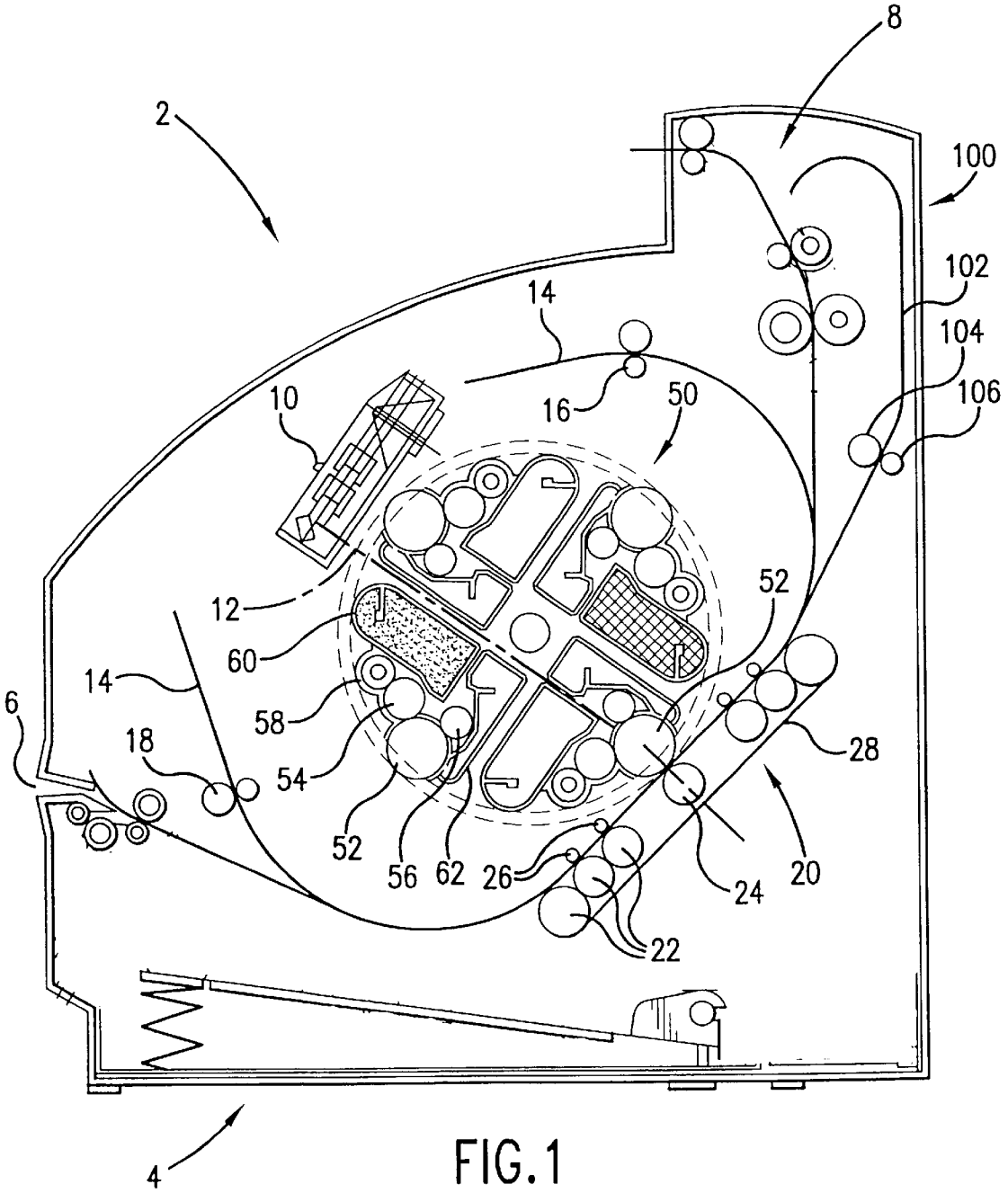
FIG. 1 is a side plan view of a carousel type shuttle color printer with all in one EP cartridges, according to the present invention.

With reference first to FIG. 1, there is illustrated an advantageous environment for use of the concepts of this invention. With respect to FIG. 1, a carousel type shuttle color printer 2 is shown. Printer 2 includes, in part, conventional automatic paper infeed mechanism 4, conventional manual paper infeed mechanism 6, conventional paper outfeed mechanism 8, conventional exposure device 10, conventional laser beam 12, paper shuttle path 14, pinch rollers 16, 18, paper transfer mechanism 20, rotatable color image forming unit 50, and duplex mechanism 100.

With respect to paper shuttle path 14, during the shuttling of the paper (not shown), pinch rollers 16, 18 and paper transfer mechanism 20, operate to move the paper back and forth along paper shuttle path 14 by conventional techniques such as set forth in the above referenced '642 patent. Preferably, paper shuttle path 14 is located along the sides of color image forming unit 50 and is located along the sides of printer 2 by conventional techniques.

With respect to paper transfer mechanism 20, paper transfer mechanism 20 includes, in part, pinch rollers 22, 26, transfer roller 24, and transfer belt 28. It is to be understood that transfer belt 28 contains a grit—like material on its outer side (the side in contact with the paper) in order to more efficiently shuttle the paper.

With respect to color image forming unit 50, color image forming unit 50 includes, in part, photoconductor drum 52, developer roller 54, charge roller 56, foam roller 58, toner reservoir 60, and waste toner reservoir 62. It is to be understood that while only one of the color development stations of color image forming unit 50 has been described, the other color development stations are constructed in the same manner.

With respect to duplex mechanism 100, duplex mechanism 100 includes, in part, paper shuttle path 102 and pinch rollers 104 and 106. Paper shuttle path 102 is located along the sides of color image forming unit 50 in the same manner as paper shuttle path 14. Also, paper shuttle path 102 is placed along the sides of printer 2 in the manner as paper shuttle path 14. Duplex mechanism 100 allows the paper to be printed by conventional techniques on both sides through the use of paper shuttle path 102, pinch rollers 104 and 106, and paper transfer mechanism 20 by conventional techniques.

Figure 2:
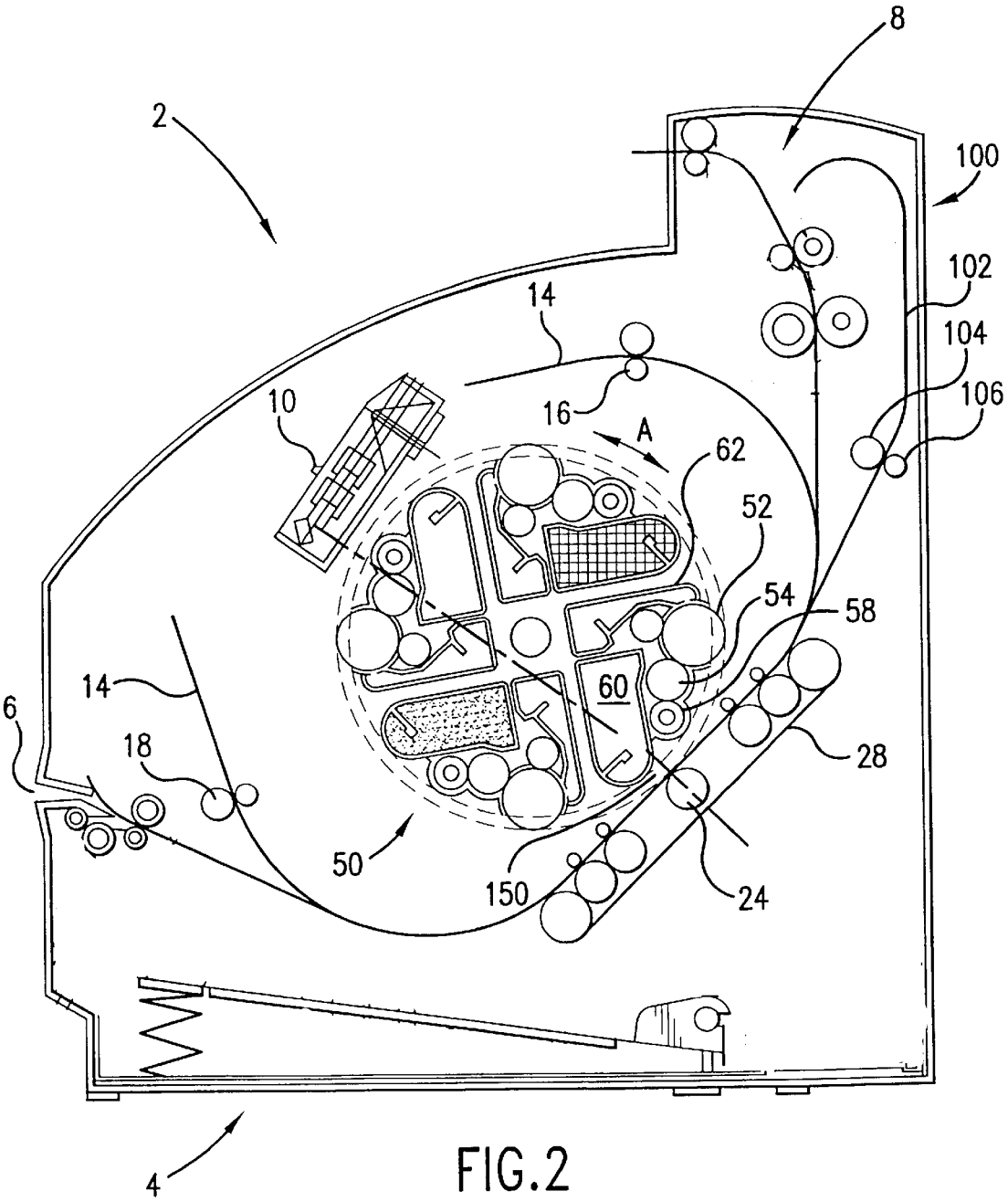
FIG. 2 is a side plan view of the carousel type shuttle color printer with all in one EP cartridges in its intermediate, non-printing position, according to the present invention.

FIG. 2 illustrates color image forming unit 50 after it has been rotated along the directions of arrows A. As can be seen in FIG. 2, toner reservoir 60, preferably, is now located directly across from transfer roller 24. In this manner, a gap 150 now can be seen between toner reservoir 60 and transfer roller 24. Gap 150, preferably, is approximately 5 mm. This gap 150 allows the paper which is being printed upon to be easily and efficiently shuttled between paper shuttle path 14, paper transfer mechanism 20, and/or duplex mechanism 100.

During the operation of carousel type color shuttle printer 2, paper is transferred from automatic paper infeed mechanism 4 or manual paper infeed mechanism 6 by conventional techniques. At this point, printer 2 selects which color is going to be printed upon the paper. Printer 2 rotates color image forming unit 50 such that the photoconductor drum 52 of the color to be printed is located across from transfer roller 24, as shown in FIG. 1. The paper is then printed according to conventional techniques such as those set forth in the above referenced '642 patent.

If another color needs to be printed upon the paper, the color image forming unit 50 is rotated along the directions of arrows A to create gap 150, as shown in FIG. 2. The paper is then shuttled by pinch rollers 16, 18, paper transfer mechanism 20, and/or duplex mechanism 100. Color image forming unit 50 is then rotated along the directions of arrows A to locate the new desired color, i.e., the photoconductor drum 52 of the new desired color, across from transfer roller 24. In this manner, the paper to be printed upon does not contact the photoconductor drum 52 and inadvertently picks up unwanted toner from photoconductor drum 52 which may deleteriously affect the print quality on the paper. After the new color i.e., photoconductor drum 52 is located across from transfer roller 24, the new color is printed on the paper according to conventional techniques. This procedure is implemented until the further colors are to be printed upon the paper.

Once given the above disclosure, many other features, modifications or improvements will become apparent to the skilled artisan. Such features, modifications or improvements are, therefore, considered to be a part of this invention, the scope of which is to be determined by the following claims.

What is claimed is:

1. A carousel type shuttle color printer, comprising:

a rotatable, color image forming unit having a plurality of different color development stations, wherein said color image forming unit is located substantially on one side of a paper to be printed upon such that said color image forming unit substantially contacts the paper; and a paper transfer means located substantially adjacent to the other side of said paper such that said paper transfer means substantially contacts said paper, wherein said color image forming unit rotates to an intermediate, non-printing position during a switching between said plurality of different color development stations to produce a gap between said color image forming unit and said paper, wherein said paper transfer means comprises; a transfer roller which contacts said color image forming unit, a transfer belt means located substantially adjacent to said transfer roller, and a paper shuttle path means located substantially adjacent to said transfer belt means.

2. The printer, as in claim 1, wherein said color image forming unit is further comprised of:

an exposing means;

a photoconductor drum which is interacted upon by said exposing means;

a developer roller operatively connected to said photoconductor drum;

a charge roller operatively connected to said photoconductor drum;

a foam roller operatively connected to said developer roller;

a toner reservoir operatively connected to said developer roller and said foam roller; and a waste toner reservoir operatively connected to said photoconductor drum and said charge roller.

3. The printer, as in claim 1, wherein said transfer belt means is further comprised of:

a first plurality of pinch rollers; and a transfer belt operatively connected to said first plurality of pinch rollers.

4. The printer, as in claim 3, wherein said paper shuttle path means is further comprised of:

at least one paper shuttle path; and a second plurality of pinch rollers operatively connected to said at least one paper shuttle path.

5. The printer, as in claim 3 wherein said transfer belt is further comprised of:

a grit-like material located substantially on one side of said transfer belt such that said grit-like material substantially contacts an edge of said paper to be printed.

6. The printer, as in claim 1, wherein said gap is approximately 5 mm.

* * * * *

UNITED STATES PATENT AND TRADEMARK OFFICE

CERTIFICATE OF CORRECTION

PATENT NO. : 6,415,123 B1
DATED : July 2, 2002
INVENTOR(S) : Arcaro et al.

It is certified that error appears in the above-identified patent and that said Letters Patent is hereby corrected as shown below:

Column 1,
Line 16, "Arcaro - et al." should read -- Arcaro et al. --;

Signed and Sealed this

Sixth Day of July, 2004

JON W. DUDAS
*Acting Director of the United States Patent and Trademark Office*